United States Patent [19]

Delgado

[11] Patent Number: 4,892,190

[45] Date of Patent: Jan. 9, 1990

[54] BICYCLE CASE

[76] Inventor: Charles B. Delgado, 416 21st Ave., South, Nashville, Tenn. 37203

[21] Appl. No.: 367,800

[22] Filed: Jun. 19, 1989

[51] Int. Cl.[4] ..... B65D 85/68

[52] U.S. Cl. ..... 206/335; 206/304

[58] Field of Search ..... 206/335, 523, 304, 446, 206/592, 564, 391

[56] References Cited

U.S. PATENT DOCUMENTS

| | | | |
|---|---|---|---|
| 4,353,464 | 10/1982 | Bentler | 206/335 |
| 4,390,088 | 1/1983 | Brenner | 206/335 |
| 4,693,289 | 9/1987 | Taylor et al. | 206/335 |
| 4,756,416 | 7/1988 | Johnson | 206/335 |

*Primary Examiner*—Joseph Man-Fu Moy

*Attorney, Agent, or Firm*—Harrington A. Lackey

[57] ABSTRACT

A bicycle case having a pair of hinged container sections having opposed upper and bottom chambers for receiving the partially disassembled parts of a bicycle. The bottom chamber includes a pair of parallel longitudinal support bars secured to the opposite end walls of the bottom container section and a pair of transverse support bars having their end portions clamped to and slidably supported upon the longitudinal support bars. One or more tie devices, each including a clamp device for securing the tie devices to a corresponding transverse support bar and including a tie or strap member, are positioned along either or both transverse support bars for securing the strap member to a portion of the bicycle frame mounted upon the support bars. The bicycle case is uniquely adapted for containing all of the partially disassembled parts of a mountain bike to facilitate transportation of the mountain bike.

9 Claims, 2 Drawing Sheets

BICYCLE CASE

BACKGROUND OF THE INVENTION

This invention relates to a bicycle case, and more particularly to a device for securing a partially disassembled bicycle frame within a carrying case.

Bicycle carrying cases or containers are known in the art, as shown in the following U.S. patents:

| | | |
|---|---|---|
| 3,886,988 | Garrett et al | June 3, 1975 |
| 4,149,634 | Lewis, Jr. et al | Apr. 17, 1979 |
| 4,353,464 | Bentler | Oct. 12, 1982 |
| 4,378,883 | Profeta | Apr. 5, 1983 |
| 4,390,088 | Brenner | June 28, 1983 |
| 4,756,416 | Johnson | July 12, 1988 |

The Garrett et al U.S. Pat No. 3,886,988 discloses a flexible bag for carrying a bicycle.

The Lewis et al U.S. Pat. No. 4,149,634 discloses a bicycle shipping case in which the front wheel, the seat post, and the handle bar have been removed from the bicycle frame and packaged separately within the same container.

The Bentler U.S. Pat. No. 4,353,464 discloses a container for the storage and transport of a bicycle partially disassembled, having a hinged cover and multi-level contours for storing bicycle components in relative spatial isolation.

The Profeta U.S. Pat. No. 4,378,883 discloses a bicycle carrying case having a pair of hinged sides with the interior contoured to the shape of the bicycle.

The Brenner U.S. Pat. No. 4,390,088 discloses a bag-type container for a disassembled bicycle.

The Johnson U.S. Pat. No. 4,756,416 discloses tie straps 26, 28, 30, and 33 for securing the bicycle frame within the case and spaced from the bottom wall 37. However, the tie straps are fixed to their respective positions on the interior of the side and end walls. The top cover of the carrier in the Johnson patent includes receptacles for both bicycle wheels.

U.S. Pat. No. 478,954, issued to Davis on July 12, 1892 discloses a packing case for vehicle wheels including a cross-bar f and clamps c.

However, none of the above patents disclose a case having longitudinal support bars fixed between the end walls of the case with adjustable transverse bars supporting adjustable tie devices which can be located in numerous positions for securing various parts of the bicycle to hold it within the bicycle case.

SUMMARY OF THE INVENTION

The bicycle case made in accordance with this invention includes a pair of hinged container sections having opposing upper and lower chambers with an adjustable support system mounted in the lower chamber for securing a major portion of a partially disassembled bicycle within the case.

The support system for the bicycle frame includes a pair of elongated, parallel, longitudinal support bars extending between the end walls of the lower container section. Clamped for adjustable slidable movement along the longitudinal support bars are a pair of transverse support bars. Mounted on one or both of the transverse support bars are one or more tie devices including a tie member or strap member for encircling and detachably securing a portion of the frame or the wheel of the bicycle in place. The tie devices also include clamp members for adjustably clamping the tie devices to various longitudinal positions on the transverse support bars.

In a preferred form of the invention, the bicycle frame is disassembled so that the front wheel, seat, and handle bar are removed, and the frame including the rear wheel, is laid longitudinally flat upon the support bars. The transverse support bars are moved along the longitudinal support bars and the tie devices are moved along the transverse support bars and then clamped in place on the respective support bars to locate the tie members in position where they can be secured to adjacent portions of the frame. In one example, the tie member secured to the rear support bar is tied to the rim of the rear wheel. The tie member on the front support bar may be secured to the lower frame bar of the bicycle frame, while another tie member may be secured to the loose handle bar to hold all the respective parts in place.

Preferably, the front wheel is secured flat against the top wall of the case. The bicycle pedals, seat and other accessories may be placed in bags and secured in place by appropriate securing means to the top and bottom walls of the case so that all the parts are secured when the case is closed and ready for travel.

DESCRIPTION OF THE PREFERRED EMBODIMENT

Figures 1, 2:
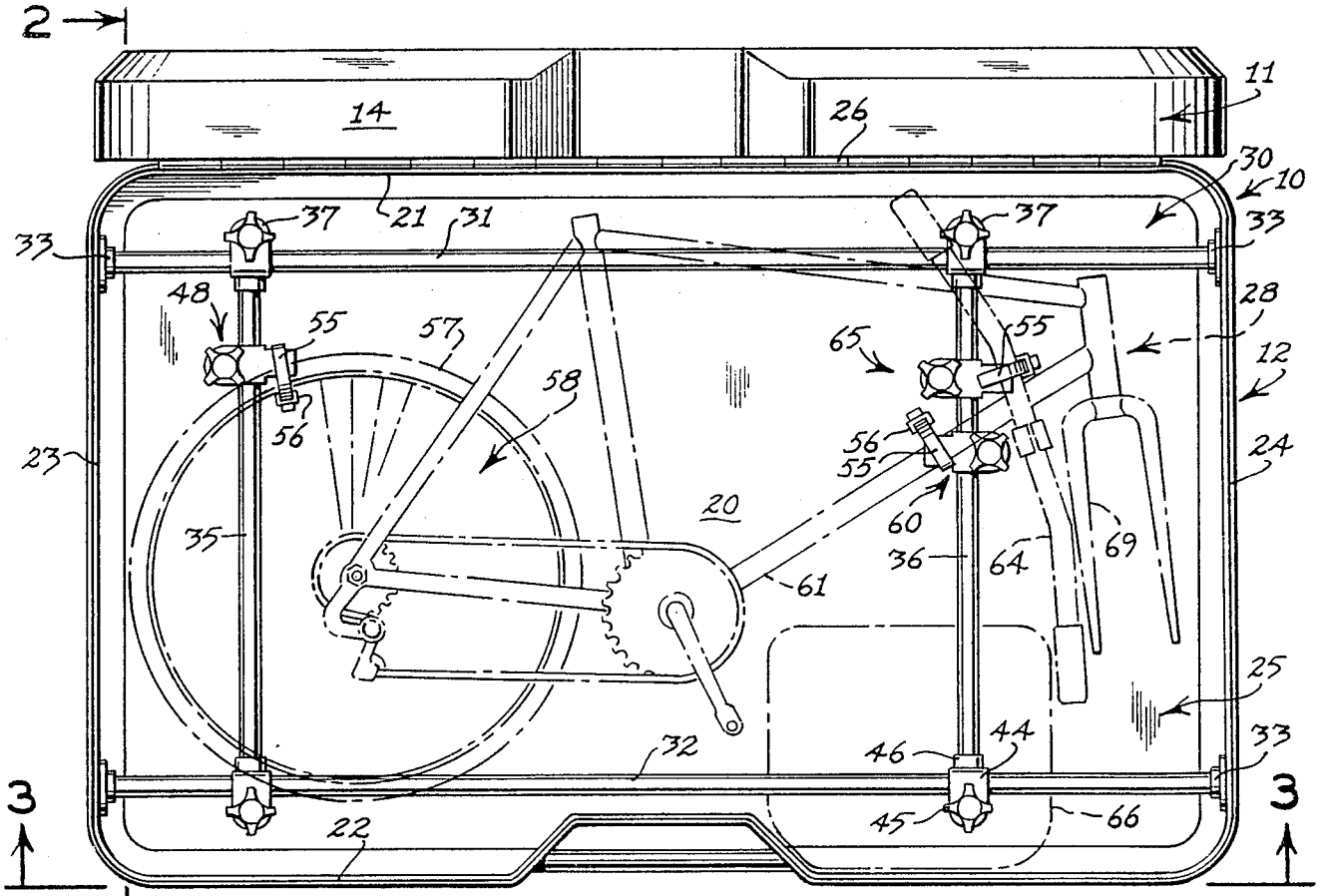
FIG. 1 is a top plan view of the bicycle case made in accordance with this invention, with the upper container section raised to an open position, and with a partially disassembled bicycle frame, shown in phantom, secured within the bottom container section of the case.
FIG. 2 is an enlarged fragmentary section taken along the line 2—2 of FIG. 1.

Referring now to the drawings in more detail, FIGS. 1-4 disclose a bicycle case 10 made in accordance with this invention including an upper or top container section 11 and a bottom container section 12.

Figure 3:
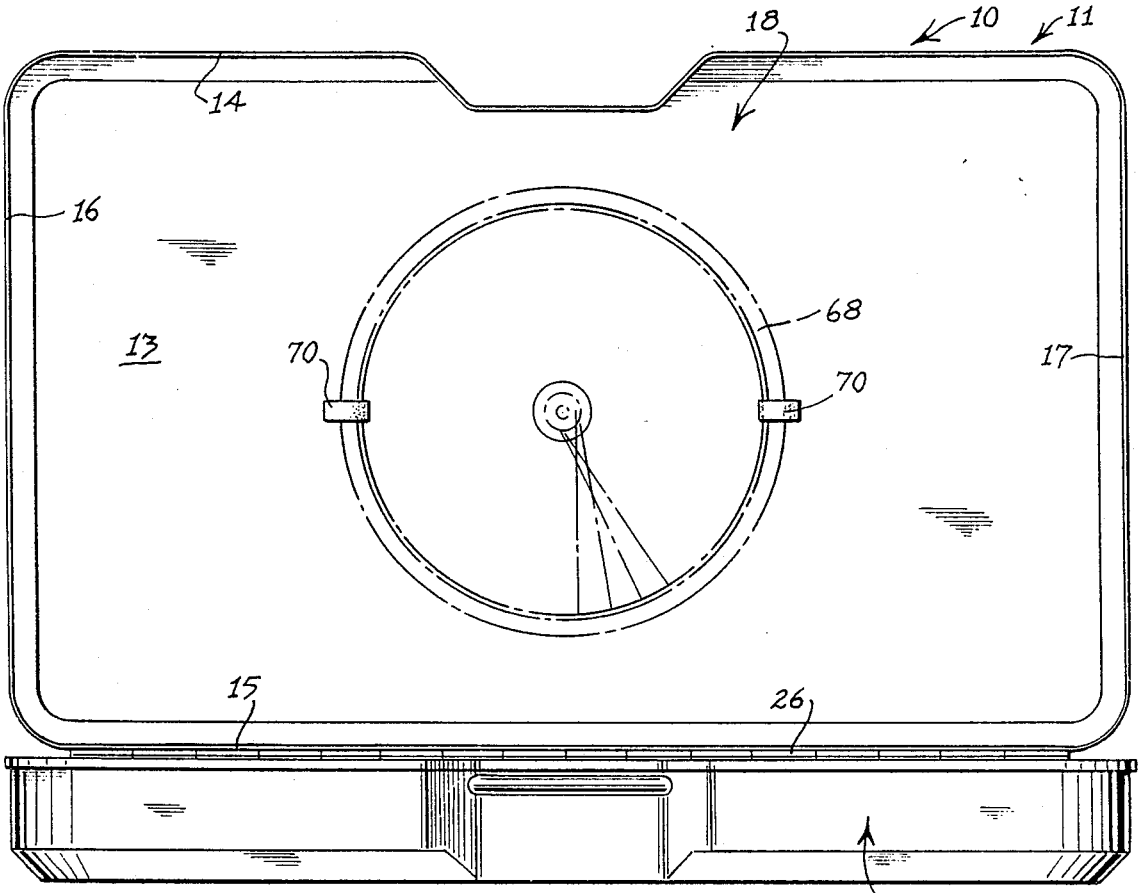
FIG. 3 is a front side elevation of the case taken along the line 3—3 of FIG. 1.

The upper container section 11 is preferably rectangular in shape including a top wall 13, side walls 14 and 15, and end walls 16 and 17 defining an upper chamber 18 having a lower or bottom opening (FIG. 3).

In a similar manner, the bottom container section 12 is also rectangular and of substantially the same shape, length and width, and preferably substantially the same depth as the upper container section 11. The bottom container section 12 includes a bottom wall 20, a pair of elongated side walls 21 and 22, a pair of opposed end walls 23 and 24 defining a bottom chamber 25 having an upper or top opening and opposing the upper chamber 18 when the case 10 is in its closed position, as disclosed FIG. 4.

Figure 4:
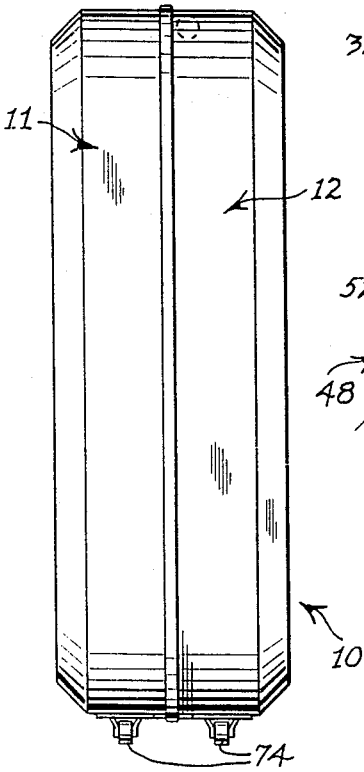
FIG. 4 is an end elevation of the case in closed position.

The top and bottom container sections 11 and 12 are connected together by an elongated piano hinge 26 connecting opposing walls, such as the side walls 15 and 21, to permit the top container section or cover 11 to swing between a closed position, as disclosed in FIG. 4, and an open position as disclosed in FIGS. 1–3. Other types of hinge means may be used if desired.

As best disclosed in FIGS. 1 and 2, the major portion of a disassembled bicycle frame, such as the mountain bicycle frame 28, is received within the bottom chamber 25 and secured in place by the support system 30.

The bicycle support system 30 includes a pair of elongated, longitudinal support bars 31 and 32, which lie parallel to each other and spaced from the bottom wall 20, as best illustrated in FIG. 2. The opposite ends of the support bars 31 and 32 are fixedly attached to the end walls 23 and 24 of the bottom container section 12, such as by the collars or sockets 33.

Slidably secured to the parallel longitudinal support bars 31 and 32 are a pair of longitudinally spaced parallel transverse support bars 35 and 36.

Figure 5:
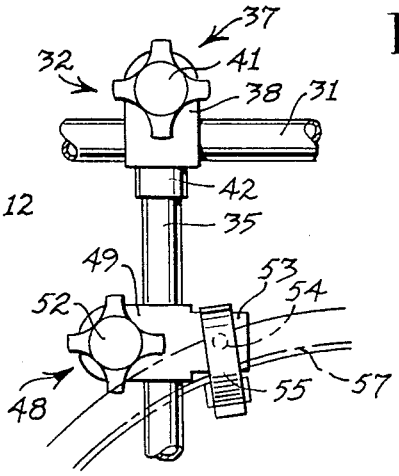
FIG. 5 is an enlarged fragmentary plan view of a portion of the support system disclosed in FIG. 1, secured to a portion of the rear wheel.
Figure 6:
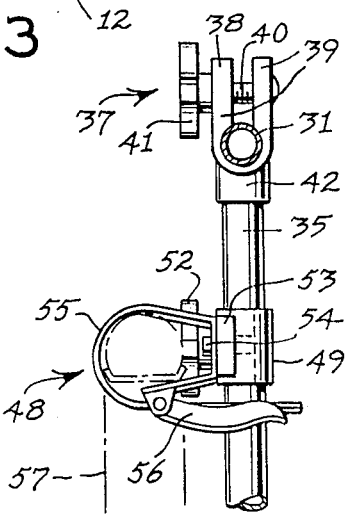
FIG. 6 is a right end elevation of the portion of the support system disclosed in FIG. 5.

One end of each of said transverse support bars 35 and 36 is connected to a clamp device 37. Each clamp device 37, as best disclosed in FIGS. 5 and 6, includes a clevis-type clamp 38 having a pair of legs 39 spanning opposite sides of the transverse bar 31. Extending through corresponding holes, not shown, in both legs 39 is a threaded bolt 40. Threadedly secured to the free end of the bolt 40 is a wing nut type handle 41. As the handle 41 is rotated clockwise upon the threaded shank of the bolt 40, the jaws or legs 39 are drawn together tightly about the circumference of the longitudinal support bar 31. The other side or other end of each clamp device 37 includes a socket or collar 42 for receiving the first end of the corresponding transverse bar 35 or 36.

By counter-rotating the wing nut handle 41, the jaws 39 are separated to loosen the clamp device 37 upon the longitudinal support bar 31 and permit the clamp device 37 to slide longitudinally along the support bar 31. When the proper or desired position is attained, the slidable movement of the clamp device 37 is stopped, the handle 41 turned clockwise and the clamp device 37 securely clamped tightly upon the longitudinal transverse bar 31.

In a similar manner, the opposite or second ends of the transverse bars 35 and 36 are secured to the clamp devices 44 which are identical in construction to the clamp devices 37. Each clamp device 44 is a clevis-type clamp having a wing nut type handle 45 and a collar 46 receiving the corresponding end of the transverse support bar 35 or 36. Preferably, the clamp devices 37 and 44 for the same transverse bar 35 are loosened and tightened and maneuvered at the same time in order to translate each transverse bar 35 or 36 longitudinally of the corresponding support bars 31 and 32 simultaneously.

Slidably and adjustably mounted upon the transverse support bar 35 is a tie device 48 including a clevis-type clamp 49 having movable legs or jaws 50 secured by a threaded bolt 51 and a wing nut type handle 52, in the same manner as the clamp device 37.

Projecting from the opposite side of the clevis clamp 49 is a post or flange 53 to which is pivotally secured by the pivot pin 54, an elongated tie or strap member 55. The strap member 55 is long enough to completely encircle the particular part of the bicycle frame 28 desired to be secured by the tie device 48. Each strap member 55 is provided with a clasp 56 for holding the opposite end portions of the strap member 55 together secured about the corresponding bicycle part. The clasp 56 could be a conventional buckle, or it could be a lever type of toggle mechanism or clamp, or any conventional means for securing opposite ends of a strap together. The strap member 55 is swivelly mounted to the post 53 by means of the pivot pin 54 to enable the strap member to be more accurately positioned for securing the particular bicycle part.

As best disclosed in FIG. 1, the strap member 55 of the tie device 48 is secured about the rim and the tire 57 of the rear wheel 58 of the bicycle frame 28, while the frame 28 is lying on top of the support system 30, that is upon the top of the support bars 31, 32, 35, and 36.

Also, as disclosed in FIG. 1, another tie device 60, of the same construction as the tie device 48, except that the tie device 60 is the mirror image of the tie device 48, is adjustably clamped to the transverse support bar 36 in the same manner as the tie device 48 is clamped to the support bar 35. The strap member 55 of the tie device 60 is swivelled to a position where it can best encircle the lower frame bar 61. The tie device 60 functions in the same manner as the tie device 48. Each tie device 48 and 60 may be loosened by counter-rotating the corresponding handle 52 and sliding the respective clamp device 48 or 60 along its corresponding transverse bar 35 or 36 until the clamp device is properly positioned. Each tie or strap member 55 may be swiveled about its pivot pin 54 in the best position for encircling the part, such as the bottom frame bar 61, and having its opposite ends secured together by an appropriate clasp or buckle 56.

Also as disclosed in FIG. 1, the handle bar 64, which has been removed from the frame 28, may be secured by the strap member 55 of another tie device 65, identical to the tie devices 48 and 60.

The seat member and pedals, not shown, which have been removed from the frame 28 may be carried in a sack or bag 66 and either secured or laid unsecured upon the bottom wall 20 in the bottom chamber 25 beneath the support system 30.

As best disclosed in FIGS. 2 and 3, the front wheel 68, which has been detached from the front wheel fork 69 may be secured against the top wall 13 by straps 70 affixed to the top wall 13 by means such as rivets 71. The opposite ends of the straps 70 are secured by "VELCRO" fasteners 72 (FIG. 2), or by snap fasteners or any other fastener means.

Although the partially disassembled bicycle frame 28 projects above the open top of the bottom chamber 25, as best illustrated in FIG. 2, nevertheless, such portions are laterally displaced from the front wheel 68, so that these parts will not interfere with each other when the cover 11 is closed against the bottom section 12.

Other space within the case 10 may be filled with other articles or bags or containers for articles, such as other bicycle gear or clothing of the cyclist transporting the case 10.

The adjacent side walls 15 and 21 of the respective top and bottom sections 11 and 12 may be provided with projecting or depending wheels 74 (FIGS. 2 and 4) to permit the closed case 10 to be rolled along the floor where such rolling is permitted, in order to minimize manual lifting of the case 10.

The case 10 and support system 30 may receive and support other types of bicycle frames than the mountain bicycle frame 28.

What is claimed is:

1. A case for receiving a disassembled bicycle, comprising:

(a) an elongated bottom container section having a bottom wall, opposed elongated side walls, and opposed end walls defining a bottom chamber large enough to receive a bicycle frame and an assembled rear wheel, and having an upper opening, (b) an elongated top container section having a top wall, opposed elongated side walls, and opposed end walls defining an upper chamber of substantially the same length and width as said bottom chamber and having a depth great enough to receive flat against said top wall the disassembled front wheel of the bicycle frame received in said bottom chamber, and having a lower opening, (c) said top and bottom container sections having a closed position in which said corresponding side and end walls engage each other and said upper and lower openings oppose each other to enclose the contents of said container sections, and an open position in which said container sections are separated, (d) a bicycle support system comprising first and second longitudinal support bars in said bottom chamber having opposite ends secured to said opposed end walls of said bottom section, said longitudinal support bars being spaced from said bottom wall and parallel to each other, (e) said bicycle support system further comprising a pair of transverse support bars having lengths less than the width of said bottom section and having first and second end portions, (f) first clamp means connected to said first end portions and second clamp means connected to said second end portions, said first clamp means slidably engaging said first longitudinal support bar and said second clamp means slidably engaging said second longitudinal support bar, (g) means for actuating said clamp means to selectively secure said clamp means on said corresponding longitudinal support bar, and (h) at least one tie device, each said tie device comprising a clamp member adapted to adjustably secure said tie device upon a transverse support bar, and a tie member adapted to be secured around a component of a bicycle frame assembly received on said support system.

2. The invention according to claim 1 in which said at least one tie device comprises a first tie device having its clamp member secured to one of said transverse support bars and a second tie device having its clamp member secured to said other transverse support bar, said first tie device being adapted to be mounted adjacent the rim of the rear wheel assembled on a bicycle frame received on said support system, said tie member on said first tie device being large enough to encircle and hold the rim of said rear wheel, said second tie device being adapted to be mounted adjacent a frame portion of said bicycle frame received on said support system, said tie member of said second tie device being large enough to encircle and secure said frame portion.

3. The invention according to claim 2 in which said clamp member comprises a clevis clamp having jaws on opposite sides of a corresponding transverse support bar slidably engaging said transverse support bar and screw means for moving said clamp jaws toward and away from each other for tightening and loosening said clevis clamp upon said transverse support bar.

4. The invention according to claim 3 further comprising means pivotally connecting said tie member to said clevis clamp to permit swivel movement between said tie member and said clamp member.

5. The invention according to claim 4 in which said tie member comprises a strap member having clasp means for securing said tie member around a part of a bicycle frame received on said support system.

6. The invention according to claim 1 in which each of said first and second clamp means comprises a clevis clamp having opposed jaws adapted to slidably receive a corresponding portion of said longitudinal support bar, and screw means for moving said jaws toward and away from each other in order to tighten and loosen said clevis clamp jaws upon said longitudinal support bar.

7. The invention according to claim 6 further comprising socket means on each of said clevis clamps of said first and second clamp means for receiving the corresponding end portion of a transverse support bar.

8. The invention according to claim 1 further comprising means securing the rim of a front wheel disassembled from a bicycle frame against said top wall within said upper chamber.

9. The invention according to claim 2 further comprising a third tie device having a clamp member adjustably secured to said transverse support bar upon which said second tie device is mounted, the tie member of said third tie device being adapted to be secured about a portion of the handle bar disassembled from a bicycle frame received in said bottom chamber.

* * * * *